US006502620B1

(12) United States Patent
Jacobsen et al.

(10) Patent No.: US 6,502,620 B1
(45) Date of Patent: Jan. 7, 2003

(54) METHOD OF CONTROLLING THE MOVEMENTS OF THE SQUEEZE PLATES OF A STRING MOULDING APPARATUS AND STRING MOULDING APPARATUS

(75) Inventors: Ole Anders Jacobsen, Tisvildeleje (DK); Kaj Jørgen Jensen, Lyngby (DK); Jan Bechmann Johansen, Humlebæk (DK); Vagn Mogensen, Gentofte (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 09/889,848

(22) PCT Filed: May 11, 1999

(86) PCT No.: PCT/DK99/00264

§ 371 (c)(1),
(2), (4) Date: Jul. 23, 2001

(87) PCT Pub. No.: WO00/67934

PCT Pub. Date: Nov. 16, 2000

(51) Int. Cl.[7] ..... B22C 25/00

(52) U.S. Cl. ..... 164/18; 164/322; 164/323

(58) Field of Search ..... 164/18, 322, 323, 164/187

(56) References Cited

U.S. PATENT DOCUMENTS 5,647,424 A 7/1997 Larsen et al.

*Primary Examiner*—Kuang Y. Lin
(74) *Attorney, Agent, or Firm*—Larson & Taylor PLC

(57) ABSTRACT

The present invention relates to a method of controlling the movements of the squeeze plates of a string moulding apparatus, and to an apparatus for carrying out the method. Such an apparatus generally comprises a moulding chamber defined between two squeeze plates. One of the squeeze plates can be pivoted to open the moulding chamber. The production cycle of an apparatus of said kind comprises apart from the charging of the chamber with mould material several movements of the squeeze plates. A movement of one plate commences before the preceding movement of the other plate has finished. The hydraulic system of the apparatus comprises two pumps, one pump for each actuator associated to one of the squeeze plates.

7 Claims, 3 Drawing Sheets

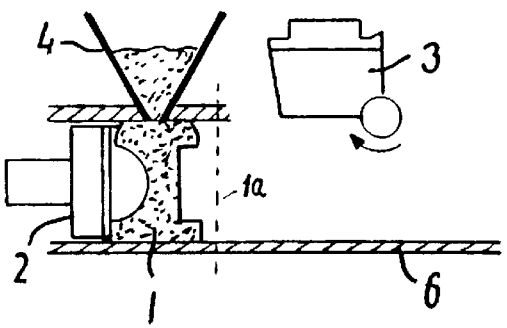
FIG. 1
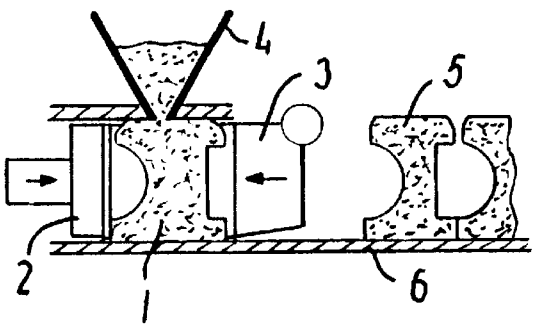
FIG. 1a
FIG. 1b
FIG. 1c
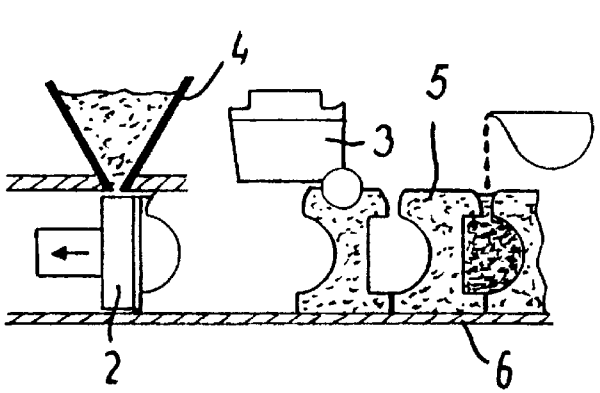
FIG. 1d
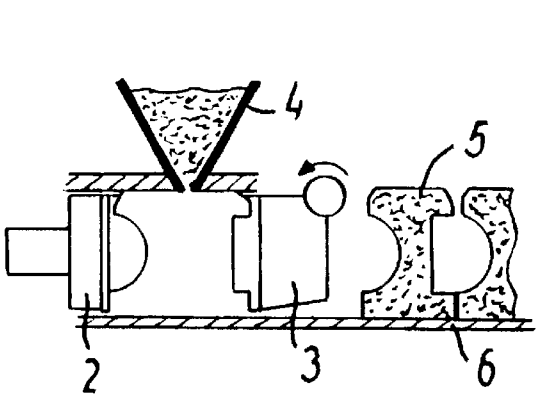
FIG. 1e

METHOD OF CONTROLLING THE MOVEMENTS OF THE SQUEEZE PLATES OF A STRING MOULDING APPARATUS AND STRING MOULDING APPARATUS

TECHNICAL FIELD

The present invention relates to a method of controlling the movements of the squeeze plates of a string moulding apparatus and to an apparatus for carrying out the method. Such an apparatus comprises generally a moulding chamber defined between two squeeze plates. One of the squeeze plates can be pivoted to open the moulding chamber.

BACKGROUND ART

A method of this general kind is known from U.S. Pat. No. 5,647,424. According to this method, the squeeze plates carry out a number of sequential movements in order to produce a mould. The moulding process comprises the steps of charging the moulding chamber with compressible mould material, e.g. clay-bonded green sand, pressing the mould material between a squeeze plate and a pivoted squeeze plate thus forming the mould, retracting the pivoted squeeze plate and pivoting the pivoted squeeze plate out of the way, moving the squeeze plate towards and past the pivoted squeeze plate for pushing the mould out from the moulding chamber and bringing it into abutment with a mould having been produced immediately before, and moving the squeeze plates back to their respective starting positions, whereafter a new cycle begins.

The forces exercised during the mould squeezing are of considerable dimension. Moreover, in order to produce high quality moulds it is necessary to provide exact guiding for the squeeze plates which can withstand bending forces that are caused by the reactive forces of the mould material not always being distributed evenly across the front surface of the squeeze plates with their associated patterns so that the resultant of these forces is not parallel to the axis of the moulding chamber. Thus, the actuators and the associated guiding system tend to be heavy constructions that can both withstand these forces and provide the required precise guiding. Consequently, the speed with which the squeeze plates can move is relatively low due to the large inertia of the elements to be moved. Attempts to reduce the length of the operating cycle of these types of machines by increasing the speed of the movements of the squeeze plates have consequently not been very successful.

DISCLOSURE OF THE INVENTION

It is the object of the present invention to provide a method of controlling the movements of the squeeze plates of a string moulding apparatus of the kind referred to above which allows a shorter operating cycle without increasing the speed of the movements, thus resulting in a higher production. This object is achieved with a method of controlling the movements of the squeeze plates of a string moulding apparatus of said kind as discussed in detail hereinafter. With this method, the movement of one of the squeeze plates can commence before the movement of the other squeeze plate has finished and thus the production rate can be increased.

According to an embodiment of the invention, the movement of the squeeze plate further into and past the moulding chamber and past the pivoted squeeze plate to transport the mould beyond the pivoted squeeze plate starts at such a time that the mould face formed by the pivoted squeeze plate will reach the chamber front just after the moment, where the pivoted squeeze plate starts its pivoting movement. In order to achieve this timing, the distance between mould surface of the squeeze plate to the moulding chamber front is taken into account.

According to a further embodiment of the invention, the pivoting movement of the pivoted squeeze plate back into the moulding chamber to resume its starting position is started when collision between the pivoted squeeze plate and the retracting squeeze plate is excluded. Hereto the thickness of the pattern associated with the squeeze plate is also taken into account.

It is a further object of the present invention to provide a string moulding apparatus of the kind referred to above for carrying out the method. This object is achieved with a string moulding apparatus of said kind as discussed in detail hereinafter. With this apparatus, the movement of one of the squeeze plates can commence before the movement of the other squeeze plate has finished and thus the apparatus has a higher production rate.

According to yet another embodiment of the invention, the pumps are variable displacement pumps. This embodiment does not require the use of proportional valves, thereby reducing the amount of throttling of the hydraulic fluid.

According to a further embodiment of the invention, the pumps are fixed displacement pumps. In order to do without proportional valves, the pumps are driven at a variable speed.

According to a further embodiment of the invention the pumps are double-sided pumps. This embodiment allows braking energy to be returned to the pump.

According to a further embodiment of the invention, the first hydraulic linear actuator is connectable in a closed circuit with the one double-sided pump and the second linear hydraulic actuator is connectable in a closed circuit with the other double-sided pump. With this embodiment, the system can be operated with a certain amount of pre-tension resulting in a better positional control.

According to a further embodiment of the invention, the first and second hydraulic linear actuators are connectable in an open circuit to the first and second pumps, whereby the delivery conduit of the first hydraulic linear actuator is connectable to the delivery conduit of the second linear hydraulic actuator so that the hydraulic pressure acting on the actuators is equalised. This embodiment allows the force applied by the hydraulic actuators on the mould during compression to be equalised.

According to a further embodiment of the invention, the first and second pumps are coupled to a common drive shaft, so that the braking energy of one actuator can be used to drive the other actuator. With this embodiment, the braking energy of one actuator can be transferred to the other actuator.

According to a further embodiment of the invention, the further pumps of the apparatus, such as servo pumps, are connected to common drive shaft.

BRIEF DESCRIPTION OF THE DRAWINGS

In the following detailed part of the description, the invention will be explained in more detail with reference to the exemplary embodiments of the method of controlling the movements of the squeeze plates of a string moulding apparatus and a string moulding apparatus for carrying out the method, according to the invention shown in the drawings, in which FIGS. 1, 1*a*, 1*b*, 1*c*, 1*d* and 1*e* diagrammatically illustrate six stages during the production of a mould.

DESCRIPTION OF THE PREFERRED EMBODIMENTS

Figure 2:
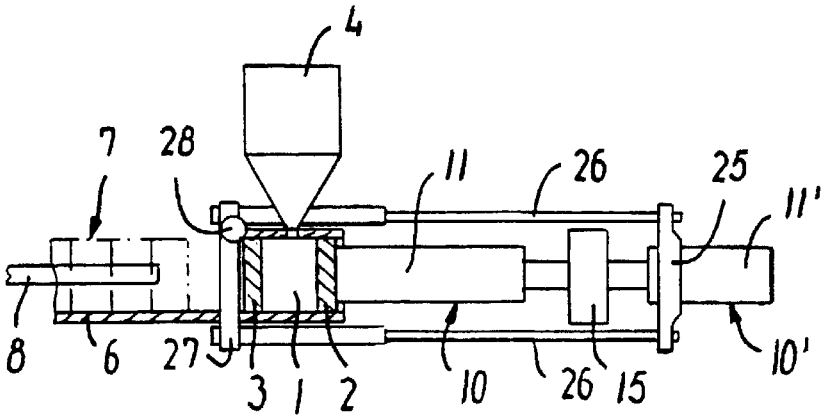
FIG. 2 shows a diagrammatic view of the guiding and actuating system of the apparatus.

In FIGS. 1, 1*a* to 1*e*, the six stages of the cycle of producing a mould in a string moulding apparatus are illustrated. In FIG. 1, a moulding chamber 1 is shown, of which one end is closed by a squeeze plate 2 carrying a pattern in its starting position, the other end being closed by a pivoted squeeze plate 3 carrying a pattern, in this Figure shown in its lowermost (starting) position. The moulding chamber 1 is filled with compressible mould material from a hopper 4. To the right side in this Figure are shown two previously produced moulds 5, resting and being conveyed stepwise on a conveyor 6, the top of which is aligned with the bottom of the moulding chamber 1.

FIG. 1*a* illustrates the bilateral pressing of a mould 5 in the moulding chamber by movement of the squeeze plate 2 into the moulding chamber 1 and movement of the pivoted squeeze plate 1 from the opposite side, viz. the chamber front 1*a*, into the moulding chamber 1 under influence of equally large and oppositely directed pressing forces, in this Figure being symbolised by arrows.

FIG. 1*b* illustrates the situation, in which the pivoted squeeze plate 3 has been withdrawn from the moulding chamber 1 and pivoted upwardly in the direction shown by an arrow to a position, in which all of it is positioned at a level higher than the upper limiting level of the moulding chamber 1, thus allowing free passage below for the freshly pressed mould 5.

FIG. 1*c* illustrates the situation in which the mould 5 is being pushed out of the moulding chamber 1 by the squeeze plate 2 into abutment with the last of the previously produced moulds 5 and, according to a preferred embodiment, further until it occupies the position previously occupied by said previously produced mould, pushing the string of moulds generally designated with 7 one step towards the right in the Figure over a distance equal to the width of a mould 5 as measured in the longitudinal direction of the mould string 7. According to another embodiment, the squeeze plate 2 retracts when the mould 5 comes into abutment with the last of the previously produced moulds. The mould string is then transported by a mould-string-transporting means 8.

FIG. 1*d* illustrates the situation in which the squeeze plate 2 is moved back to its position as shown in FIG. 1 thereby stripping the squeeze plate 2 and an associated pattern from the mould 5.

FIG. 1*e* illustrates the situation in which moulding chamber is closed by the pivoted squeeze plate 3 having returned to the moulding chamber 1. Thus, both the squeeze plate 2 and the pivoted squeeze plate 3 have returned to their starting position. The two squeeze plates 2,3 automatically centre relatively to the sand injection slot, taking into account the height of the pattern plates carried by them. Consequently, wear caused to the pattern plates is reduced to a minimum, and the moulding chamber 1 can be homogeneously filled. The moulding chamber is charged again so that a new cycle may begin. During charging, the simultaneous movement of the squeeze plates towards one another may begin.

Between the moulds 5 casting cavities are formed, of which one is in the process of being cast With metal, whereas the two cavities to the extreme right in the Figures have already been cast with metal. During the further movement of the string of moulds 7, the metal in the casting cavities solidifies and finally, the moulds 5 with the solidified castings end up on a shake-out grate (not shown), on which the mould material is separated from the castings. Many moulds require the use of a core (not shown) which is inserted into the moulding chamber 1 before the sand shot by an automatic core setter (not shown). The insertion of the core, after the squeeze plate 2 has returned to its starting position, but preferably before the pivoted squeeze plate 3 has reached its starting position, may, as in the prior art techniques, increase the cycle time.

FIG. 2 illustrates diagrammatically the construction of the string moulding apparatus. The movement of the pressure plate 2 is derived from a linear hydraulic actuator 10 comprising a cylinder member 11, to which the squeeze plate 2 is directly secured, and a piston member comprising a piston head 12 and a piston rod 13 that passes tightly through an inner end wall 14 of the cylinder 11 and is supported by a stationary block 15. The stationary block 15 is an integral part of the base frame of the apparatus. The piston member divides the cylinder chamber into an outer annular compartment 16 and an inner annular compartment 17. The piston rod 13 is hollow and defines an inner annular chamber. A second piston rod 13*a* extends from the outer end wall 18 of the cylinder 11 into the outer annular chamber 16. A second piston head 12*a* secured to the free end of the second piston rod 13*a* fits tightly in the annular chamber, thereby defining a compartment 16*a*. The compartments 16, 16*a* and 17 are connected to conduits 20, 21 and 22 for supply and discharge of pressure fluid. The cylinder member 11 actually constitutes the movable element.

The pivoted pressure plate 3 comprises an analogous linear hydraulic actuator 10' with a cylinder member 11', a piston head 12', a hollow piston rod 13', also supported by the block 15, an inner end wall 14', an outer compartment 16', an inner annular compartment 17', a second piston rod 13*a'*, an outer end wall 18', a second piston head 12', a compartment 16*a'*and conduits 20, 23 and 24.

Also in this case, it is actually the cylinder member 11' that constitutes the movable element and this cylinder member 11' is connected to the pivoted pressure plate 3 through a bracket 25 secured to the cylinder 11' at the inner end thereof, said bracket 25 being connected through push and pull rods 26 with a frame 27 supporting the pivoted squeeze plate 3 in a hinge 28. The pivoting movement about the hinge pivoted squeeze plate 3 is caused by a lever device (not shown) forcing the pivoted squeeze plate 3 to pivot upwardly when the frame 27 is moving away from the moulding chamber 1 and vice versa. When moving away from the moulding chamber 1, the pivoting movement does not start before the pivoted squeeze plate 3 has reached a minimum distance that equals at least the height of its associated pattern from the moulding chamber.

Figure 3:
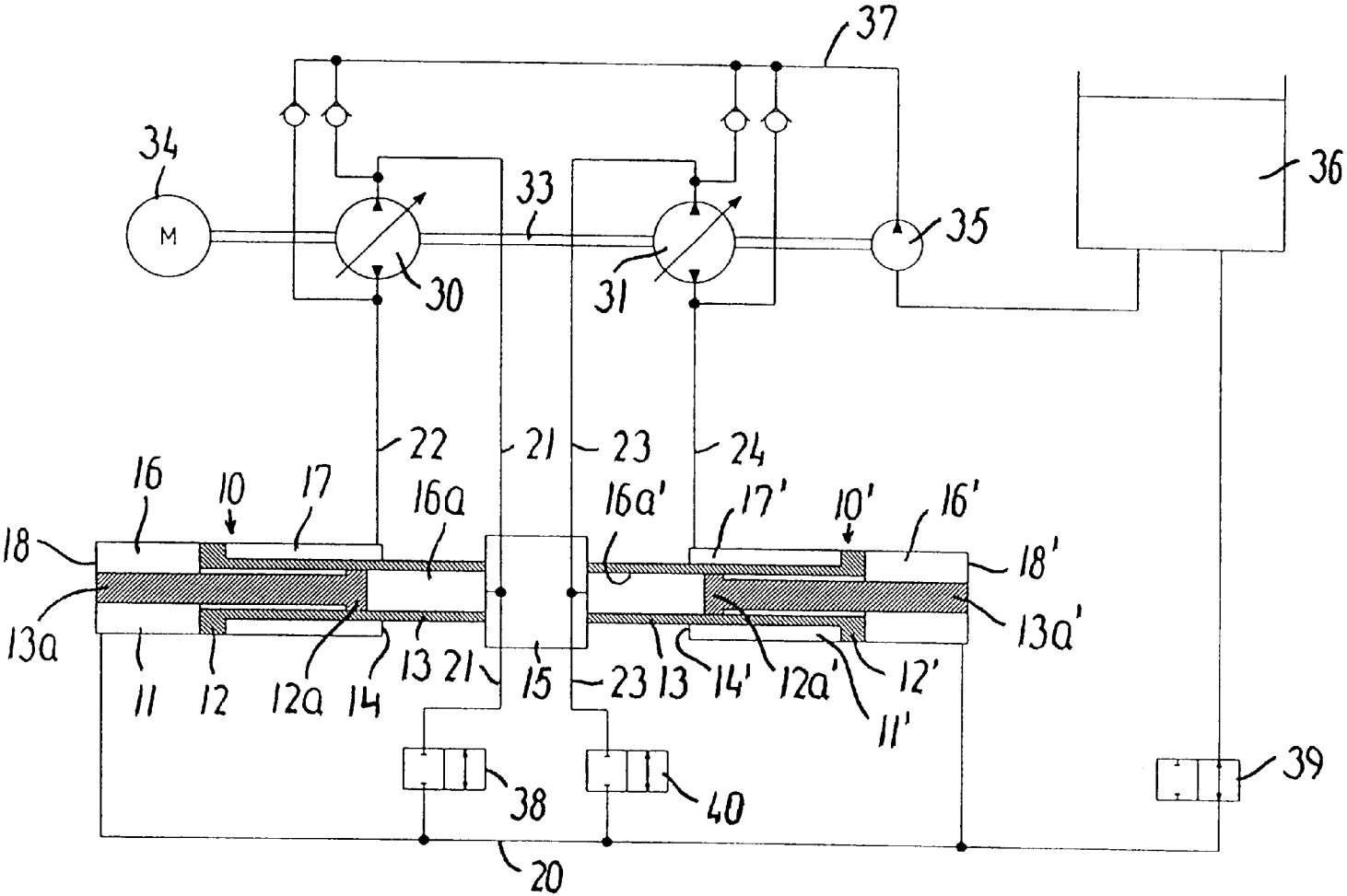
FIG. 3 shows a circuit diagram of the hydraulic system for the apparatus.

As shown in FIG. 3, the hydraulic system of the mould string apparatus comprises a first and second variable displacement hydraulic pumps 30 and 31. The pumps 30,31 are double-sided, i.e. they can deliver and receive fluid in two directions and therefore the pumps can be connected in closed circuit. In this embodiment the pumps 30,31 are swash-plate pumps having a swash-plate serving as a displacement volume varying member. The pump driving the actuator 10 associated with the squeeze plate 2 has preferably a larger capacity than the other pump, since the squeeze plate 2 is required to move at higher speed than the pivoted squeeze plate 3. A servo pump 35 delivers hydraulic fluid from a reservoir 36 to the pumps 30,31 through a conduit 37. The pumps 30,31 and 35 are coupled to a common drive shaft 33 which is driven by a motor 34. Thus, the braking energy fed back to one of the pumps is transmitted to the other pump.

Each of the two ports of the first pump 30 is connected to the conduit 37 via a separate conduit including a non-return valve. In an analogous manner, each of the ports of the second pump 31 is connected to conduit 37.

One of the ports of the first pump 30 is connected to the inner compartment 17 of the first linear hydraulic actuator 10. The other port is connected directly through conduit 21 to compartment 16*a* and further via an on/off valve 38 and through a common conduit 20 to the outer compartment 16 of the first linear hydraulic actuator 10. The conduit 20 is connected via an on/off valve 39 to the reservoir.

In an analogous manner, one of the ports of the second pump 31 is connected to the inner compartment 17' of the second linear hydraulic actuator 10'. The other port is connected directly though conduit 23 to compartment 16*a'* and further via an on/off valve 40 and through a common conduit 20 to the outer compartment 16' of the second linear hydraulic actuator 10'.

The operation of the hydraulic system during the various stages of the production cycle of the string moulding apparatus will now be described.

For bilateral pressing the mould (FIG. 1*a*), valves 38 and 40 are in the "on", i.e. the open position and valve 39 is in the "off" position. The direction of the pumps 30,31 is set to deliver the fluid under pressure to the ports that are connected to the conduits 21 and 23, respectively. Fluid under pressure is thus delivered to the compartments 16*a* and 16*a'* and through the open valves 38 and 40 to the outer compartments 16 and 16'. The inner compartments 17 and 17' are connected through conduits 22 and 24 to the suction side of the first pump 30 and the second pump 31, respectively. Since the volume of compartments 17 and 17' returning fluid is smaller than that of the compartments receiving fluid, additional fluid is drawn in by the pumps 30,31 from the reservoir 36 and delivered by the servo pump 35 via the non-return valves. A maximum pressure on the squeeze plates 2 and 3, for pressing the mould 5 in the chamber 1, is thus obtained.

For stripping the pivoted squeeze plate 3 from the mould 5 and for pivoting the pivoted squeeze plate 3 out of the way, the direction of pump 31 is set to deliver fluid under pressure to the port that is connected to conduit 24. Pressurised fluid is thus delivered to chamber 17'. In order to evacuate compartment 16', valve 39 is switched to the "on" position and the fluid is returned via the open valve 39 through the conduit 20 to the reservoir 36. The fluid evacuating from compartment 16*a'* is returned to the pump through conduit 23, since the valve 40 is switched in the "off" position.

For pushing the mould 5 but of the moulding chamber 1 with the squeeze plate 2 (FIG. 1*c*), the pump 30 is set to deliver fluid under pressure to the port that is connected to the conduit 21. Valve 38 is switched to its "off" position, thus only chamber 16*a* is pressurised. The fluid evacuating from chamber 17 is returned through conduit 22 to the pump 30.

For stripping-off the squeeze plate 2 from the mould 5 and for moving the squeeze plate 2 back to its starting position (FIG. 1*d*), pump 30 is switched to deliver fluid under pressure to the port connected to conduit 22. Thus, compartment 17 is pressurised. The fluid evacuating from chamber 16*a* is returned to the pump 30 through conduit 21, the valve 38 is switched to the "off" position. The fluid evacuating from the compartment 16 is returned through conduit 20 via the open valve 39 to the reservoir 36.

For returning the pivoted squeeze plate 3 to the moulding chamber 1 (FIG. 1*e*), the pump 31 is set to deliver fluid under pressure to the port connected to conduit 23. Valve 40 is switched to its "off" position, thus only chamber 16*a'* is pressurised. The fluid evacuating from chamber 17' is returned through conduit 24 to the pump 31.

Figure 4:
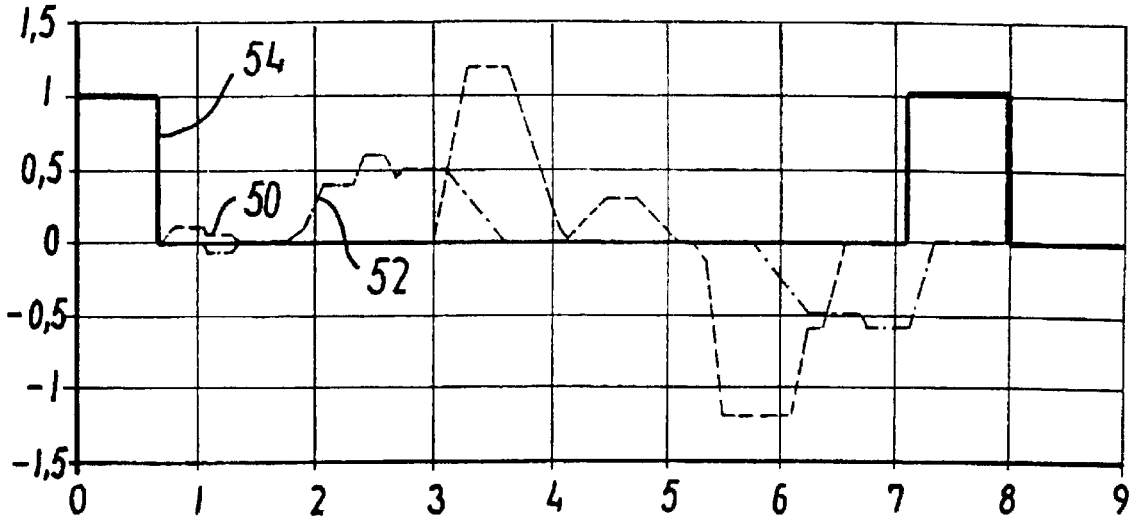
FIG. 4 shows is a plot of the speed of the squeeze plates versus time, i.e. a speed profile, according to an embodiment of the invention.

With reference to FIG. 4 the movements of the pressure plates 2 and 3 are illustrated by means of a plot of the speed in m/s versus time in seconds. The line with reference numeral 50 represents the speed of the squeeze plate 2. The line with reference numeral 52 represents the speed of the pivoted squeeze plate 3, whereas the line with reference numeral 54 indicates the time in which the sand is shot into the moulding chamber 1.

After the sand shot, the bilateral squeezing of the mould 5 is initiated by the squeeze plate 2. The start of the pressing movement of the pivoted squeeze plate is, as explained in more detail in U.S. Pat. No. 5,647,424, delayed with respect to the squeeze plate 2 in order to compensate for the limited stroke of the pivoted squeeze plate 3. In apparatus with an extended stroke of the pivoted squeeze plate 3, the pressing movement of the squeeze plates 2,3 can commence simultaneously. Next, the pivoted squeeze plate 3 is stripped off the mould 5 and pivoted out of the way. Before this movement of the pivoted squeeze 3 plate has finished, the squeeze plate 2 starts to move further into and past the moulding chamber 1 to push out the mould 5. This movement is however preferably not started before the pivoted squeeze plate 3 and its associated pattern have passed the front 1*a* of the moulding chamber 1. The squeeze plate 2 continues it movement to push the mould 5 beyond the pivoted squeeze plate 3 and slows down to a complete standstill when the front of the mould 5 abuts with the previously produced mould 5. The movement of the squeeze plate 2 is thereafter continued so that the last and previously produced moulds are moved together as a stack or string 7 of moulds 5. When movement of the mould string 7 is completed, the movement of the squeeze plate 2 is reversed to move back to the starting position. Before the squeeze plate 2 has reached its starting position, the pivoted squeeze plate 3 starts to pivot and move back to the moulding chamber 1. The timing of the movement of the pivoted squeeze plate 3 back to the moulding chamber 1 is calculated taking into account the geometry and position versus time of the pivoted squeeze plate 3, the geometry and the position versus time of the squeeze plate 2 and the associated patterns. Before the pivoted squeeze plate 3 has reached its starting position again, in which it closes the moulding chamber 1, the sand shot is started, and a new cycle begins.

According to a modified embodiment of the invention, the centring of the two squeeze plates is done simultaneously.

According to another modified embodiment of the invention only the squeeze plate 2 moves during the pressing of the mould 5, whereby the pivoted squeeze plate 3 remains stationary.

According to still another modified embodiment of the invention, the pumps 30, 31 are fixed displacement pumps.

In this embodiment, either the speed at which the pumps are driven is varied or proportional valve are used in order to vary the amount of fluid delivered to the actuators.

| REFERENCE NUMERALS | |
|---|---|
| 1 | moulding chamber |
| 1a | moulding chamber front |
| 2 | squeeze plate |
| 3 | pivoted squeeze plate |
| 4 | hopper |
| 5 | mould |
| 6 | conveyor |
| 7 | mould string |
| 8 | mould-string-transporting means |
| 9 | sand injection slot |
| 10 | first linear hydraulic actuator |
| 10' | second linear hydraulic actuator |
| 11 | cylinder |
| 11' | cylinder |
| 12 | piston head |
| 12' | piston head |
| 12a | second piston head |
| 12a' | second piston head |
| 13 | piston rod |
| 13' | piston rod |
| 13a | second piston rod |
| 13a' | second piston rod |
| 14 | inner end wall |
| 14' | inner end wall |
| 15 | stationary block |
| 16 | outer annular compartment |
| 16' | outer annular compartment |
| 16a | compartment |
| 16a' | compartment |
| 17 | inner annular compartment |
| 17' | inner annular compartment |
| 18 | outer end wall |
| 18' | outer end wall |
| 20 | conduit |
| 21 | conduit |
| 22 | conduit |
| 23 | conduit |
| 24 | conduit |
| 25 | bracket |
| 26 | push and pull rods |
| 27 | frame |
| 28 | hinge |
| 30 | first pump |
| 31 | second pump |
| 33 | common drive shaft |
| 34 | motor |
| 35 | servo pump |
| 36 | reservoir |
| 37 | conduit |
| 38 | on/off valve |
| 39 | on/off valve |
| 40 | on/off valve |
| 50 | speed of squeeze plate |
| 52 | speed of pivoted squeeze plate |
| 54 | sand shot |

What is claimed is:

1. Method of controlling a movement of squeeze plates of a string moulding apparatus comprising a moulding chamber located between a squeeze plate and a pivoted squeeze plate, at least one of the squeeze plates being provided with a pattern, comprising the sequential steps of:

a) moving the squeeze plate alone, or both the squeeze plate and the pivoted squeeze plate, from a starting position into the moulding chamber to press a mould, b) moving the pivoted squeeze plate out of the moulding chamber and pivoting the pivoted squeeze plate to strip the pivoted squeeze plate from the mould and to open the moulding chamber to allow the mould to be transported beyond the pivoted squeeze plate, c) moving the squeeze plate further into and past the moulding chamber and past the pivoted squeeze plate to transport the mould beyond the pivoted squeeze plate, d) moving the squeeze plate back into the moulding chamber to strip the squeeze plate from the mould and to resume the starting position thereof, e) pivoting and moving the pivoted squeeze plate back to the moulding chamber to resume the starting position thereof and to close the moulding chamber, wherein one of (i) the moving of the pivoted squeeze plate out of the moulding chamber in step b) starts before the moving of the squeeze plate to press the mould in step a) has ended, (ii) the moving of the squeeze plate further into and past the moulding chamber in step c) starts before the moving and pivoting of the pivoted squeeze plate to open the moulding chamber in step b) has ended, or (iii) the pivoting and moving of the pivoted squeeze plate back to the moulding chamber in step e) starts before the moving of the squeeze plate to the starting position thereof has ended.

2. Method according to claim 1, wherein the moving of the squeeze plate further into and past the moulding chamber in step c) starts when a mould face formed by the pivoted squeeze plate reaches a mould chamber front and after when the pivoting movement of the pivoted squeeze plate in step b) has started.

3. Method according to claim 1, wherein the pivoting movement of the pivoted squeeze plate in step e) starts as soon as a collision between the pivoted squeeze plate and the squeeze plate and the associated patterns is excluded.

4. Method according to claim 1, wherein both of:

(i) the moving of the pivoted squeeze plate out of the moulding chamber in step b) starts before the moving of the squeeze plate to press the mould in step a) has ended, and (ii) the moving of the squeeze plate further into and past the moulding chamber in step c) starts before the moving and pivoting of the pivoted squeeze plate to open the moulding chamber in step b) has ended.

5. Method according to claim 1, wherein both of:

(i) the moving of the pivoted squeeze plate out of the moulding chamber in step b) starts before the moving of the squeeze plate to press the mould in step a) has ended, and (iii) the pivoting and moving of the pivoted squeeze plate back to the moulding chamber in step e) starts before the moving of the squeeze plate to the starting position thereof has ended.

6. Method according to claim 1, wherein both of:

(ii) the moving of the squeeze plate further into and past the moulding chamber in step c) starts before the moving and pivoting of the pivoted squeeze plate to open the moulding chamber in step b) has ended, and (iii) the pivoting and moving of the pivoted squeeze plate back to the moulding chamber in step e) starts before the moving of the squeeze plate to the starting position thereof has ended.

7. Method according to claim 1, wherein all of:

(i) the moving of the pivoted squeeze plate out of the moulding chamber in step b) starts before the moving of the squeeze plate to press the mould in step a) has ended, (ii) the moving of the squeeze plate further into and past the moulding chamber in step c) starts before the moving and pivoting of the pivoted squeeze plate to open the moulding chamber in step b) has ended, and (iii) the pivoting and moving of the pivoted squeeze plate back to the moulding chamber in step e) starts before the moving of the squeeze plate to the starting position thereof has ended.

* * * * *